United States Patent [19]

Wong et al.

[11] 4,158,183

[45] Jun. 12, 1979

[54] COMPACT, IN-PLANE ORTHOGONAL MODE LAUNCHER

[75] Inventors: Mon N. Wong, Culver City; Stanley T. Ibrao, Torrance, both of Calif.

[73] Assignee: Hughes Aircraft Company, Culver City, Calif.

[21] Appl. No.: 753,034

[22] Filed: Dec. 22, 1976

[51] Int. Cl.[2] ..... H01P 1/17

[52] U.S. Cl. ..... 333/21 A; 343/797

[58] Field of Search ..... 333/21 R, 21 A; 343/786, 797

[56] References Cited

U.S. PATENT DOCUMENTS

| | | | |
|---|---|---|---|
| 3,086,203 | 4/1963 | Hutchison | 333/21 R X |
| 3,740,754 | 6/1973 | Epis | 343/797 |
| 4,030,048 | 6/1977 | Foldes | 333/21 A X |

FOREIGN PATENT DOCUMENTS

| | | | |
|---|---|---|---|
| 644768 | 10/1950 | United Kingdom | 333/21 A |

*Primary Examiner*—Paul L. Gensler

*Attorney, Agent, or Firm*—Rafael A. Cardenas; W. H. MacAllister

[57] ABSTRACT

A single in-plane orthogonal mode launcher for generating circularly polarized waves having both right and left hand senses is disclosed. A 90° hybrid provides first and second signals to respective input ports of the launcher. First and second coplanar sets of probes are orthogonally disposed in a cylindrical housing and connected to the first and second ports, respectively. The first set of probes generates a first vector signal. The second set of probes generates a second vector signal which is 90° to the first vector signal. Since the input signals to the first and second sets of probes are 90° out of phase, circularly polarized waves are thus generated.

4 Claims, 4 Drawing Figures

Fig. 1.
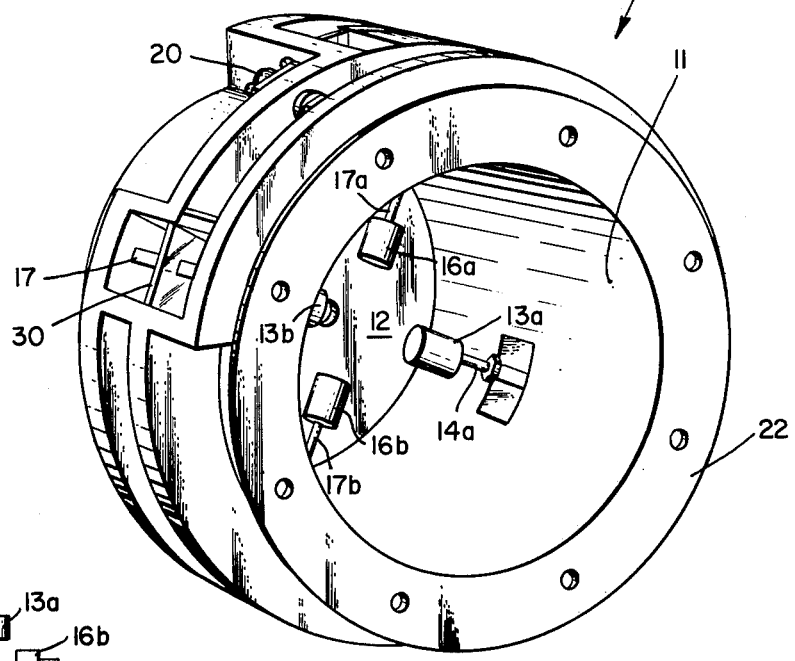
Fig. 4.
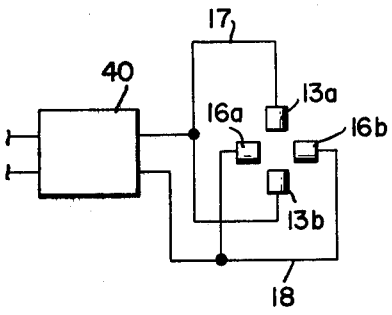
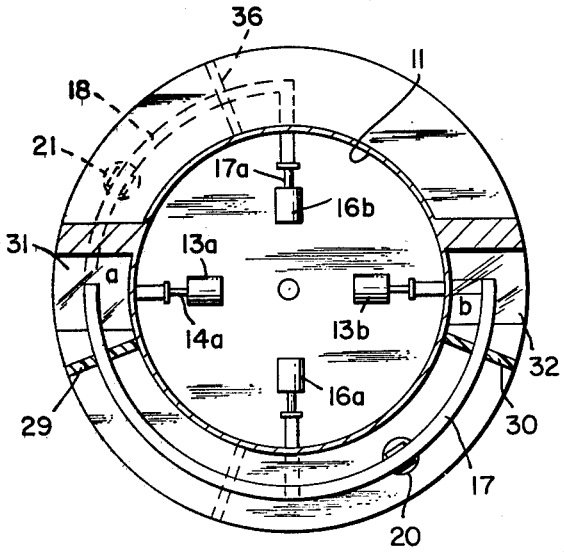
Fig. 3.
Fig. 2.
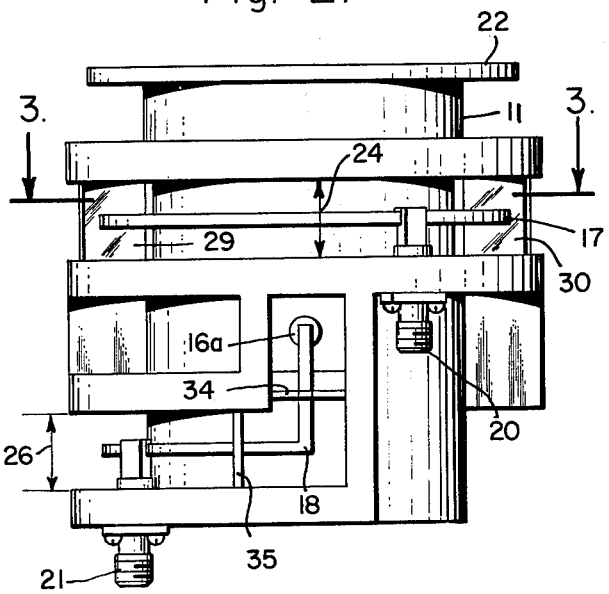

COMPACT, IN-PLANE ORTHOGONAL MODE LAUNCHER

FIELD OF THE INVENTION

The invention relates generally to microwave devices and in particular the invention relates to a single unit microwave launcher for generating circularly polarized waves.

DESCRIPTION OF THE PRIOR ART

Microwave devices for generating circularly polarized waves are well known in the prior art. One such device utilizes two orthogonal probes in the same plane mounted within a cylindrical housing, to which first and second quadrature signals are applied. A limitation of such a two-probe device is poor isolation due to lack of symmetry within the cylindrical housing resulting in coupling between the two orthogonal probes. For example, a launcher operating in the frequency band of 3.7 to 4.2 GHz, the best isolation obtainable between circularly polarized waves is 15 dB. The isolation may be improved if the two probes are separated from each other; i.e., taking them out of the same plane. The result, however, is an increase in length and weight, which has adverse effects for space applications requiring minimum weight and minimum volume. Generally, the greater the separation there is between the two probes the greater the isolation, but also at the sacrifice of bandwidth. If the same phase angle signal is applied to the two probes, an additional microwave device must be used which is commonly known as a polarizer. This solution, however, also increases the weight and space required to generate circularly polarized waves.

Another microwave launcher which is well known in the prior art is a one-port launcher having a first set of two active probes located 180° to each other within the same plane in a cylindrical housing. A set of two load probes, 180° to each other, is also located in the same plane and 90° to the first set of active probes. Having such first and second sets of probes so arranged improves the symmetry of the launcher and hence the isolation. However, a separate polarizer must be used and only one circularly polarized sense may be generated at a time, since there is only one input port.

OBJECTS AND SUMMARY OF THE INVENTION

Accordingly, it is an object of the present invention to provide a simpler, lightweight, reliable and more efficient in-plane orthogonal mode launcher for generating circularly polarized waves.

It is another object of the present invention to provide a launcher having improved isolation.

It is another object of the present invention to provide a launcher having improved bandwidth.

It is yet another object of the present invention to provide an improved launcher requiring no internal matching irises.

In accordance with the above objects, an in-plane orthogonal mode launcher includes a housing having coplanar first and second sets of probes orthogonal to each other. A first input signal applied to the first set of probes generates a first vector, a second signal, 90° out of phase to the first signal, applied to the second set of probes generates circularly polarized waves having first and second senses.

BRIEF DESCRIPTION OF THE DRAWINGS

FIG. 1 is a diagram illustrating a perspective view of an in-plane orthogonal mode launcher according to the present invention;

FIG. 2 is a diagram illustrating a side view of the present invention according to FIG. 1;

FIG. 3 is a diagram illustrating plan view cross section of an orthogonal mode launcher according to FIG. 1;

FIG. 4 is a schematic block diagram illustrating the present invention.

DETAILED DESCRIPTION OF THE DRAWINGS

Referring now to FIG. 1, an in-plane orthogonal mode launcher 10 includes a cylindrical housing 11 which is closed, or shorted, at one end 12. Disposed within the housing 11 is a first set of probes **13*a* and 13*b* 180° apart and radially aligned with the axis of the cylindrical housing 11. The probes 13*a* and 13*b* are cylindrical in shape and have a length and diameter determined by the impedance required. The probe 13*a* is supported in position by a threaded stud 14*a*, which is attached to one end of a coaxial center conductor 15 having a square cross-section, or squarax. The probe 13*b* is supported in place by a stud 14*b* FIG. 3 which is attached to the second end of the squarax conductor. The spacing between the two probes 13*a* and 13*b* is determined by the particular bandwidth width and impedance required. A second set of probes 16*a* and 16*b* is also 180° apart and radially aligned with the axis of the cylindrical housing 11. The probes 16*a* and 16*b* are identical to the first set of probes 13*a* and 13*b*, and are mounted in place by third and fourth threaded studs 17*a* and 17*b*, respectively. The studs 17*a* and 17*b* are attached to the first and second ends of a squarax center conductor 18 FIG. 3. The center conductor of the first squarax waveguide is connected to an input connector 20 and the second center conductor of the second squarax waveguide is connected to a second input connector 21** (not shown).

The cylindrical housing may be a suitable metal such as aluminum, which has an inside diameter of approximately two inches and a length of approximately two and one-half inches for a bandwidth of 3.7 and 4.2 GHz. The cylindrical housing 11 may also be fabricated from a fiberglass material which has an inside surface which is metallized. A flange such as the annular ring 22 may be provided at the open end of the cylindrical housing 11 for mounting to the antenna (not shown). A first coaxial waveguide housing 24 FIG. 2 contains the first squarax waveguide 17, a second waveguide housing 26 FIG. 2 houses the second coaxial conductor 18.

A first signal applied to the first set of probes **13*a* and 13*b* in conjunction with a second quadrature signal applied to the second set of probes 16*a*** generate circularly polarized signals of both right and left hand senses. Thus, in one small area circularly polarized signals may be generated. A launcher according to the present invention has been constructed for the bandwidth of 3.7 to 4.2 GHz, and it was found that the isolation between the two circularly polarized waves was 34 dB, which is a substantial improvement over the performance of the prior art.

FIG. 2 is a side view of the invention according to FIG. 1, illustrating the coaxial waveguides for providing the signals to the probes. The covers for the waveguide housings 24 and 26 have been removed for clarity. The coaxial conductor 17 is mounted within the waveguide housing 24 and is supported in place by dielectric spacers 29 and 30, 31 and 32 are not shown. The second coaxial center conductor 18 is supported in place by dielectric spacers 34 and 35, 36 and 37 are not shown.

Referring more specifically to FIG. 3, the plan view cross-sectional diagram about the plane 3—3 of FIG. 2 illustrates the four probes 13*a*, 13*b*, 16*a* and 16*b* within the cylindrical housing 11. It is noted that the length of the center conductor 17 from the connector 20 to one end "a" is twice the distance to the second end "b". This variation in length provides a 180° phase shift of the signal at the "a" end with respect to the "b" end. A hybrid network providing a 180° phase shift may also be utilized between the probes 13*a* and 13*b* instead of the offset coaxial conductor 17. The coaxial conductor 18 is identical to the conductor 17 and will therefore not be described in greater detail.

Referring now more specifically to FIG. 4, the schematic block diagram illustrates the two sets of orthogonal mode probes 13 and 16 connected to the first and second output ports of a 90° phase shift network 40. The first output port of the hybrid 40 is connected to the conductor 17 which, in turn, is connected to the probes 13*a* and 13*b*. The second output port of the hybrid 40 is connected to the conductor 18 which, in turn, is connected to the probes 16*a* and 16*b*. First and second input signals applied to the first and second input terminals of the 90° network result in quadrature phase signals being applied to the two sets of probes 13 and 16 for generating two senses of circularly polarized waves. The first input port of the hybrid 40 receives a first signal and provides a first output signal of the same phase, while a second output signal having a 90° phase lag is provided by the second output signal. Thus a left hand circularly polarized wave is generated by the two sets of probes as a result of the 90° phase lag of the 16*a* and 16*b* probes with respect to probes 13*a* and 13*b*. A signal applied to the second input terminal of the hybrid 40 provides an output signal of the same phase to be applied to the conductor 18 while a 90° lag signal is applied to the conductor 17. Thus, a right hand circularly polarized signal is generated as the result of probes 16*a* and 16*b* being advanced in phase by 90° with respect to probes 13*a* and 13*b*.

In summary, an improved and compact in-plane orthogonal mode launcher is disclosed which can generate circularly polarized waves having both right and left hand senses and having greater isolation between the two modes.

The orthogonal mode launcher has two sets of probes in one plane mounted within a cylindrical housing. Each set of probes has an input port and generates a separate field within the cylindrical housing which fields are in phase quadrature thus generating right and/or left hand circularly polarized waves depending upon the relative phase of the signals.

The present invention provides a plurality of functions in a relatively small volume heretofore performed by several microwave components requiring more weight and volume. The present orthogonal mode launcher provides greater symmetry between the two sets of probes which results in greater isolation between the output waves having opposite senses.

What is claimed is:

1. A compact in-plane microwave signal launcher having improved bandwidth, comprising:

right cylindrical housing having an open and a closed end;

first and second means for receiving first and second microwave input signals respectively, said first and second means being disposed on and about said cylindrical housing, and said first means for providing first and second signals being 180° out of phase, said second means being for providing third and fourth signals being 180° out of phase;

first and second cylindrical probe means radially disposed within and extending outward through said cylindrical housing means along opposing radials for receiving said first and second signals, respectively, and for generating a first field therebetween having a first direction; and third and fourth cylindrical probe means radially disposed within said cylindrical housing means along opposing radials for receiving said third and fourth signals, respectively, and for generating a second field therebetween having a direction being 90° to said first field for generating circularly polarized waves having first and second senses, said third and fourth probe means being coplanar with said first and second probe means.

2. A compact in-plane microwave signal launcher, comprising:

right cylindrical housing having an open end and a closed end;

a first coaxial conductor extending 180° about the exterior of said cylindrical housing, said first coaxial conductor having first and second ends extending into said cylindrical housing, said first coaxial conductor for receiving a first input signal and providing first and second output signals being 180° out of phase with each other;

a second coaxial conductor extending 180° about the exterior of said cylindrical housing, said second coaxial conductor having first and second ends extending into said cylindrical housing, said second coaxial conductor for receiving a second input signal and providing third and fourth output signals being 180° out of phase with each other;

first and second cylindrical probes coupled to said first and second ends, respective, of said first coaxial conductor, said first and second cylindrical probes radially disposed within said cylindrical housing along opposing radials for receiving said first and second output signals respectively, and for generating a first field therebetween having a first direction; and third and fourth cylindrical probes coupled to said first and second ends, respectively, of said second coaxial conductor, said third and fourth cylindrical probes radially disposed within said cylindrical housing along opposing radials for receiving said third and fourth output signals, respectively, and for generating a second field therebetween having a direction being 90° to said first field for generating circularly polarized waves having first and second senses, said third and fourth probes being coplanar with said first and second probes.

3. a compact in-plane microwave signal launcher having improved bandwidth, comprising:

right cylindrical housing having an open end and a closed end;

input network having first and second input ports and first and second output ports, said first and second output ports providing first and second quadrature phase signals in response to a first input signal applied to said first input port, said first and second output ports providing third and fourth quadrature phase signals in response to a second input signal applied to said second input port;

first and second means being coupled to the first and second output ports, respectively, of said input network, said first means for receiving said first and fourth quadrature signals, said second means for receiving said second and third quadrature signals, said first means for providing first and second signals being in phase opposition, said second means being for providing third and fourth signals being in phase opposition;

first and second cylindrical probe means radially disposed within and extending outward through said cylindrical housing means along opposing radials for receiving said first and second signals, respectively, and for generating a first field therebetween having a first direction; and third and fourth cylindrical probe means radially disposed within said cylindrical housing means along opposing radials for receiving said third and fourth signals, respectively, and for generating a second field therebetween having a direction being 90° to said first field for generating circularly polarized waves having first and second senses, said third and fourth probe means being coplanar with said first and second probe means.

4. A compact in-plane microwave signal launcher, comprising:

right cylindrical housing having an open end and a closed end;

input network having first and second input ports and first and second output ports, said first and second output ports providing first and second quadrature phase signals in response to a first input signal applied to said first input port, said first and second output ports providing third and fourth quadrature phase signals in response to a second input signal applied to said second input port;

a first coaxial conductor extending 180° about the exterior of said cylindrical housing and being coupled to the first output port of said input network, said first coaxial conductor having first and second ends extending into said cylindrical housing, said first coaxial conductor for receiving first and fourth quadrature signals and providing first and second signals being 180° out of phase with each other;

a second coaxial conductor extending 180° about the exterior of said cylindrical housing and being coupled to the second output port of said input network, said second coaxial conductor having first and second ends extending into said cylindrical housing, said second coaxial conductor for receiving second and third quadrature signals and providing third and fourth signals being 180° out of phase with each other;

first and second cylindrical probes coupled to said first and second ends, respectively, of said first coaxial conductor, said first and second cylindrical probes radially disposed within said cylindrical housing along opposing radials for receiving said first and second signals, respectively, and for generating a first field therebetween having a first direction; and third and fourth cylindrical probes coupled to said first and second ends, respectively, of said second coaxial conductor, said third and fourth cylindrical probes radially disposed within said cylindrical housing along opposing radials for generating a second field therebetween having a direction being 90° to said first field for generating circularly polarized waves having first and second senses, said third and fourth probes being coplanar with said first and second probes.

* * * * *